US011466340B2

(12) United States Patent
Ogasahara et al.

(10) Patent No.: US 11,466,340 B2
(45) Date of Patent: Oct. 11, 2022

(54) STEEL SHEET TEMPERATURE CONTROL DEVICE AND TEMPERATURE CONTROL METHOD

(71) Applicant: JFE Steel Corporation, Tokyo (JP)

(72) Inventors: Tomoyoshi Ogasahara, Tokyo (JP); Goki Yamada, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 1080 days.

(21) Appl. No.: 16/071,300

(22) PCT Filed: Nov. 2, 2016

(86) PCT No.: PCT/JP2016/082552

§ 371 (c)(1),
(2) Date: Jul. 19, 2018

(87) PCT Pub. No.: WO2017/130508

PCT Pub. Date: Aug. 3, 2017

(65) Prior Publication Data

US 2021/0198765 A1 Jul. 1, 2021

(30) Foreign Application Priority Data

Jan. 28, 2016 (JP) ..... JP2016-014429

(51) Int. Cl.
*C21D 11/00* (2006.01)
*C21D 1/08* (2006.01)
(Continued)

(52) U.S. Cl.
CPC ..... *C21D 11/00* (2013.01); *C21D 1/08* (2013.01); *C21D 1/26* (2013.01); *C21D 1/52* (2013.01);
(Continued)

(58) Field of Classification Search
CPC . C21D 11/00; C21D 9/56; C21D 1/26; C21D 1/08
See application file for complete search history.

(56) References Cited

U.S. PATENT DOCUMENTS

2014/0364994 A1 12/2014 Liu et al.
2015/0322539 A1* 11/2015 Takada ..... C21D 1/76 266/44
(Continued)

FOREIGN PATENT DOCUMENTS

CN 1805803 A 7/2006
CN 101962708 A 2/2011
(Continued)

OTHER PUBLICATIONS

Korean Office Action for Korean Application No. 10-2018-7021198, dated Sep. 18, 2019 with Concise Statement of Relevance of Office Action, 6 pages.
(Continued)

*Primary Examiner* — Nathaniel Herzfeld
(74) *Attorney, Agent, or Firm* — RatnerPrestia

(57) ABSTRACT

A steel sheet temperature control device including: a sheet temperature measurement unit; a furnace temperature measurement unit; an influence coefficient calculation unit; a control model setting unit that sets a control model; a state variable/disturbance estimation unit that estimates values of a state variable and a temperature disturbance variable of the control model at the same time; a furnace temperature change amount calculation unit that calculates a furnace temperature change amount of each of heating zones of a heating furnace under a constraint condition such that square sum of a deviation between a target value and the actual value of the temperature of the steel sheet at the outlet side of the heating furnace becomes minimum; and a furnace
(Continued)

temperature control unit that controls a fuel flow rate used in each of the heating zones to achieve the calculated furnace temperature change amount.

5 Claims, 6 Drawing Sheets

(51) Int. Cl.

| | |
|---|---|
| ***C21D 1/26*** | (2006.01) |
| ***C21D 1/52*** | (2006.01) |
| ***C21D 9/56*** | (2006.01) |
| ***F27D 21/00*** | (2006.01) |
| *F27D 19/00* | (2006.01) |

(52) U.S. Cl.
CPC ..... *C21D 9/56* (2013.01); *F27D 21/0014* (2013.01); *F27D 2019/0003* (2013.01); *F27D 2019/004* (2013.01)

(56) References Cited

U.S. PATENT DOCUMENTS

| | | | | |
|---|---|---|---|---|
| 2016/0377345 | A1* | 12/2016 | Custers | C21D 9/60 148/511 |
| 2017/0166990 | A1* | 6/2017 | Fushiwaki | C22C 38/14 |
| 2021/0018267 | A1* | 1/2021 | Yamamoto | F27B 9/40 |

FOREIGN PATENT DOCUMENTS

| | | | |
|---|---|---|---|
| CN | 103397171 | B | 9/2014 |
| CN | 105886751 | A | 8/2016 |
| EP | 1496129 | A1 | 1/2005 |
| JP | 60135531 | A | 7/1985 |
| JP | S6129903 | A | 2/1986 |
| JP | 6428329 | A | 1/1989 |
| JP | 01184233 | A | 7/1989 |
| JP | 03236422 | A | 10/1991 |
| JP | 04168232 | A | 6/1992 |
| JP | 0559455 | A | 3/1993 |
| JP | 2008146325 | A | 6/2008 |
| JP | 2014500939 | A | 1/2014 |
| JP | 5510787 | B2 | 6/2014 |
| JP | 2015134951 | A | 7/2015 |
| KR | 100241023 | B1 | 3/2000 |

OTHER PUBLICATIONS

Extended European Search Report for European Application No. 16 88 8093.8, dated Nov. 21, 2018, 4 pages.
International Search Report and Written Opinion for International Application No. PCT/JP2016/082552, dated Jan. 31, 2017—5 pages.
Chinese Office Action for Application No. 201680079910.0, dated Mar. 5, 2019 with English Search Report, 7 pages.

* cited by examiner

STEEL SHEET TEMPERATURE CONTROL DEVICE AND TEMPERATURE CONTROL METHOD

CROSS REFERENCE TO RELATED APPLICATIONS

This is the U.S. National Phase application of PCT/JP2016/082552, filed Nov. 2, 2016, which claims priority to Japanese Patent Application No. 2016-014429, filed Jan. 28, 2016, the disclosures of these applications being incorporated herein by reference in their entireties for all purposes.

TECHNICAL FIELD OF THE INVENTION

The present invention relates to a steel sheet temperature control device and a steel sheet temperature control method.

BACKGROUND OF THE INVENTION

In general, a continuous annealing facility for a steel sheet includes a heating furnace, an isothermal heating furnace, a cooling furnace, and the like. At the inlet side of the facility, a tail portion of a preceding material and a nose portion of a succeeding material that have different sizes in sheet thickness and sheet width, standards, and annealing conditions are welded together and are continuously processed as a single steel sheet. The object of this process is to perform a heating process suitable for each annealing condition, by switching the furnace temperature set value of each heating zone in the heating furnace before and after the welded part. Eventually, the steel sheet is cut and shipped in coil units or delivered to the next process, at the outlet side of the facility.

In the heating furnace, the temperature of a steel sheet is generally increased by radiation heating using a radiant tube. However, when the sizes and the like of the steel sheets differ before and after the welded part, the steel sheet temperatures vary because the heating conditions become the same before and after the welded part. Moreover, because the time constant required for controlling the radiant tube is large, the response is slow and the variation period of the steel sheet temperature is increased in the normal feedback control. Consequently, for example, as disclosed in Patent Literatures 1 and 2, the response is shortened by performing the feedforward control on the basis of information such as change in the size or standard of the steel sheet, and by significantly changing the furnace temperature and the fuel flow rate in a short period of time.

More specifically, Patent Literature 1 discloses a method for continuously setting a fuel flow rate by continuously measuring the emissivity of the steel sheet in advance using infrared rays, and by cancelling the temperature variation of the steel sheet predicted from the variation of emissivity, at a timing when the steel sheet reaches immediately below the burner. Patent Literature 2 discloses a method for controlling the fuel flow rate by calculating, in advance, time series data of the steel sheet temperature and the fuel flow rate that follows a target value of the steel sheet temperature with an error from the target value being kept to a minimum, using a dynamic model of the steel sheet temperature, the sheet thickness, the line speed, and the fuel flow rate.

In the feedforward control as described above, the furnace temperature and the fuel flow rate are set according to the model on the basis of information obtained in advance. However, because the feedforward control is not a control based on the measurement value of the steel sheet temperature, a control deviation occurs due to the model error.

Hence, the control gain needs to be set according to the model error. Under the circumstances, Patent Literature 3 discloses a method for specifying a response trajectory of the steel sheet temperature that changes toward the reference value of the steel sheet temperature using a certain parameter, and determining the furnace temperature on the basis of a dynamic model using variables relating to the specifications of the steel sheet such as the sheet thickness and the sheet width so as to achieve the response trajectory.

CITATION LIST

Patent Literature

Patent Literature 1: Japanese Patent No. 5510787
Patent Literature 2: Japanese Patent Application Laid-open No. 64-28329
Patent Literature 3: Japanese Patent Application Laid-open No. 3-236422

SUMMARY OF THE INVENTION

It is considered that the methods disclosed in Patent Literatures 1 and 2 effectively work to improve the responsiveness of the steel sheet temperature. However, with the methods disclosed in Patent Literatures 1 and 2, when a certain measurable disturbance element is input, the furnace temperature and the fuel flow rate of the heating furnace for achieving the target value of the steel sheet temperature are calculated using a model with an error. Consequently, a control deviation (steady-state deviation) appears in the steady-state with no disturbance element. On the other hand, the method disclosed in Patent Literature 3 implements a good responsiveness control with no steady-state deviation, by collecting the actual values of the temperature of the steel sheet at the outlet side of the heating furnace at a constant period, sequentially setting the response trajectory of the steel sheet temperature, and calculating a suitable furnace temperature set value while predicting the steel sheet temperature in future by taking into account the difference between the preceding material and the succeeding material such as the sheet thickness and the sheet width, on the model. However, in the method disclosed in Patent Literature 3, when the insertion temperature of the steel sheet is varied at the inlet side of the heating furnace at a certain timing, the model error is increased. Moreover, when the feedback control based only on the measurement value of the temperature of the steel sheet is performed at the outlet side of the heating furnace, the responsiveness will be reduced.

Thus, a steel sheet temperature control method that simultaneously satisfies two control indexes to improve the responsiveness using the feedforward control and to eliminate the steady-state deviation using the feedback control has been desired. Although the two control indexes can be designed separately, the operation amount of the feedforward control is a disturbance to the feedback control when a suitable design or adjustment is not made. Hence, it is a challenge to design the two control indexes such that they will not interfere with each other.

Aspects of the present invention have been made in view of the above problem, and an object according to aspects of the present invention is to provide a steel sheet temperature control device and a steel sheet temperature control method that can control the temperature of a steel sheet in a heating furnace with a good responsiveness and a good follow-up capability.

To solve the problem and achieve the object, a steel sheet temperature control device according to aspects of the present invention includes: a sheet temperature measurement unit that measures temperature of a steel sheet at an inlet side and an outlet side of a heating furnace including a plurality of heating zones disposed along a conveyance direction of the steel sheet; a furnace temperature measurement unit that measures furnace temperature of each of the heating zones; an influence coefficient calculation unit that calculates an influence coefficient representing temperature change of the steel sheet at the outlet side of the heating furnace in response to temperature change of the steel sheet at the inlet side of the heating furnace, and an influence coefficient representing temperature change of the steel sheet at the outlet side of the heating furnace in response to change in the furnace temperature of each of the heating zones, using a heating model equation capable of calculating the temperature of the steel sheet in the heating furnace, by inputting a set value of the temperature of the steel sheet at the inlet side of the heating furnace, and set values of the furnace temperature of each of the heating zones and sheet passing speed; a control model setting unit that sets a control model by inputting a furnace temperature change command value and outputting the furnace temperature of each of the heating zones and the temperature of the steel sheet at the outlet side of the heating furnace, by using the influence coefficient calculated by the influence coefficient calculation unit, transfer time of the steel sheet until influence of furnace temperature change in each of the heating zones appears on the temperature of the steel sheet at the outlet side of the heating furnace, a time constant from when the furnace temperature change command value of each of the heating zones is output to when the furnace temperature is actually changed, and a variable representing unknown temperature disturbance to be applied to the temperature of the steel sheet at the outlet side of the heating furnace; a state variable/disturbance estimation unit that estimates values of a state variable and a temperature disturbance variable of the control model at the same time, by inputting a deviation between an actual value of the temperature of the steel sheet at the inlet side of the heating furnace measured by the sheet temperature measurement unit and a set value, a deviation between an actual value of the temperature of the steel sheet at the outlet side of the heating furnace measured by the sheet temperature measurement unit and a set value, and a deviation between an actual value of the furnace temperature of each of the heating zones measured by the furnace temperature measurement unit and an initial set value; a furnace temperature change amount calculation unit that calculates a furnace temperature change amount of each of the heating zones under a constraint condition such that square sum of a deviation between a target value and the actual value of the temperature of the steel sheet at the outlet side of the heating furnace becomes minimum, by using the values of the state variable and the temperature disturbance variable of the control model that are estimated by the state variable/disturbance estimation unit; and a furnace temperature control unit that controls a fuel flow rate used in each of the heating zones to achieve the furnace temperature change amount calculated by the furnace temperature change amount calculation unit.

Moreover, in the steel sheet temperature control device according to aspects of the present invention, the furnace temperature change amount calculation unit includes at least one of constraint condition relating to upper and lower limit values of the furnace temperature, constraint condition relating to the furnace temperature change amount per unit time, constraint condition relating to upper and lower limit values of the fuel flow rate, and condition relating to the fuel flow rate change amount per unit time, as the constraint condition.

Moreover, in the steel sheet temperature control device according to aspects of the present invention, the influence coefficient calculation unit, the control model setting unit, the state variable/disturbance estimation unit, and the furnace temperature change amount calculation unit each execute a process for each set value of a plurality of sheet passing speeds assumable during an actual operation, and the furnace temperature control unit controls a fuel flow rate used in each of the heating zones to achieve the furnace temperature change amount calculated from the set value of the sheet passing speed close to actual sheet passing speed.

Moreover, a steel sheet temperature control method according to aspects of the present invention includes: a sheet temperature measuring step that measures temperature of a steel sheet at an inlet side and an outlet side of a heating furnace including a plurality of heating zones disposed along a conveyance direction of the steel sheet; a furnace temperature measuring step that measures furnace temperature of each of the heating zones; an influence coefficient calculating step that calculates an influence coefficient representing temperature change of the steel sheet at the outlet side of the heating furnace in response to temperature change of the steel sheet at the inlet side of the heating furnace, and an influence coefficient representing temperature change of the steel sheet at the outlet side of the heating furnace in response to change in the furnace temperature of each of the heating zones, using a heating model equation capable of calculating the temperature of the steel sheet in the heating furnace, by inputting a set value of the temperature of the steel sheet at the inlet side of the heating furnace, and set values of the furnace temperature of each of the heating zones and sheet passing speed; a control model setting step that sets a control model by inputting a furnace temperature change command value and outputting the furnace temperature of each of the heating zones and the temperature of the steel sheet at the outlet side of the heating furnace, by using the influence coefficient calculated at the influence coefficient calculating step, transfer time of the steel sheet until influence of furnace temperature change in each of the heating zones appears on the temperature of the steel sheet at the outlet side of the heating furnace, a time constant from when the furnace temperature change command value of each of the heating zones is output to when the furnace temperature is actually changed, and a variable representing unknown temperature disturbance to be applied to the temperature of the steel sheet at the outlet side of the heating furnace; a state variable/disturbance estimating step that estimates values of a state variable and a temperature disturbance variable of the control model at the same time, by inputting a deviation between an actual value of the temperature of the steel sheet at the inlet side of the heating furnace measured at the sheet temperature measuring step and a set value, a deviation between an actual value of the temperature of the steel sheet at the outlet side of the heating furnace measured at the sheet temperature measuring step and a set value, and a deviation between an actual value of the furnace temperature of each of the heating zones measured at the furnace temperature measuring step and an initial set value; a furnace temperature change amount calculating step that calculates a furnace temperature change amount of each of the heating zones under a constraint condition such that square sum of a deviation between a target value and the actual value of the temperature of the steel sheet at the outlet side of the heating furnace becomes minimum, by using the values of the state variable and the temperature disturbance variable of the control model that are estimated at the state variable/disturbance estimating step; and a furnace temperature controlling step that controls a fuel flow rate used in each of the heating zones to achieve the furnace temperature change amount calculated at the furnace temperature change amount calculating step.

With the steel sheet temperature control device and the steel sheet temperature control method according to aspects of the present invention, it is possible to control the temperature of a steel sheet in a heating furnace with a good responsiveness and a good follow-up capability.

DETAILED DESCRIPTION OF EMBODIMENTS OF THE INVENTION

Hereinafter, a configuration of a steel sheet temperature control device according to an embodiment of the present invention and the operation thereof will be described in detail with reference to the accompanying drawings.

Figure 1:
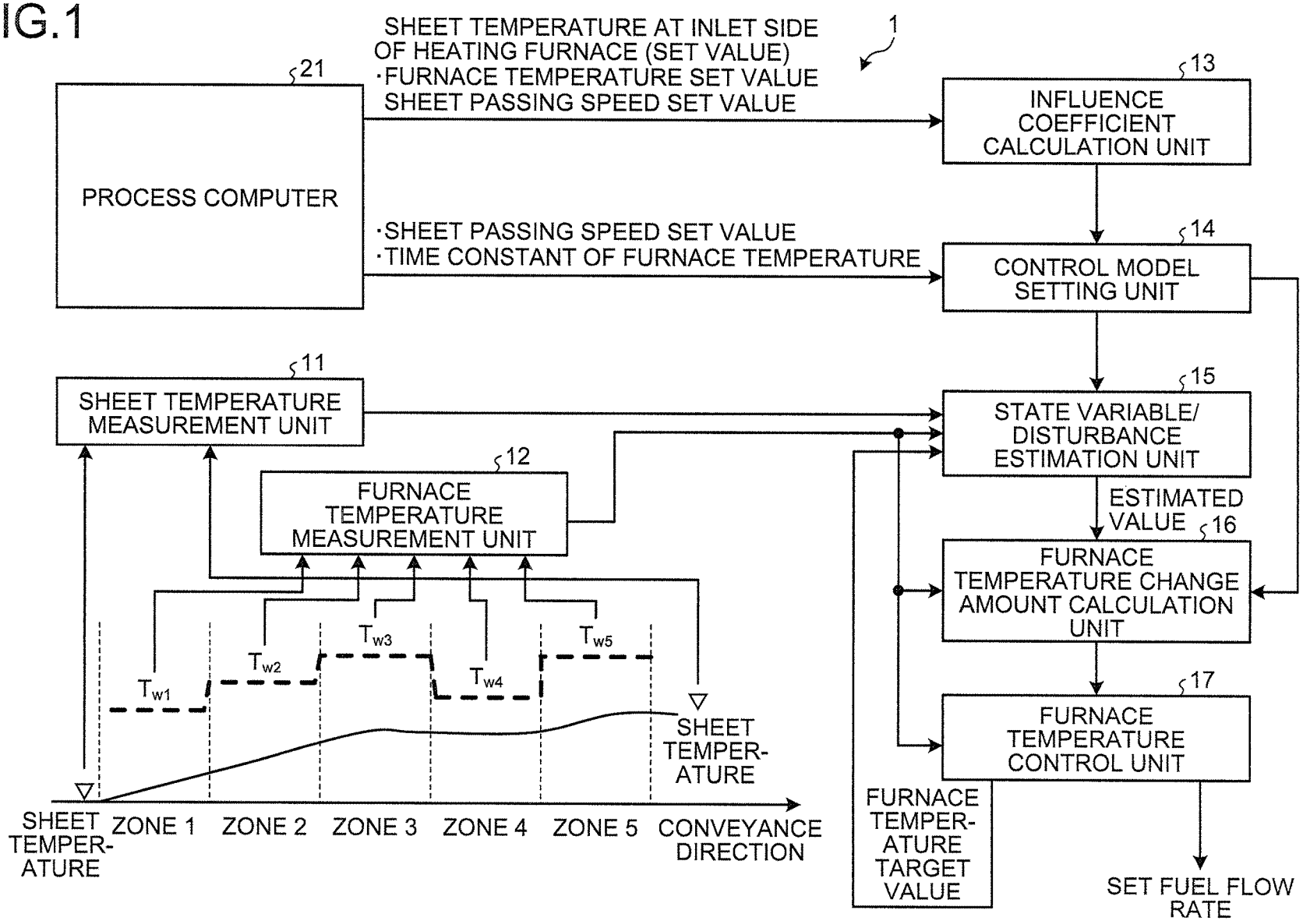
FIG. 1 is a block diagram illustrating a configuration of a steel sheet temperature control device according to an embodiment of the present invention.

FIG. 1 is a block diagram illustrating a configuration of a steel sheet temperature control device according to the embodiment of the present invention. As illustrated in FIG. 1, a steel sheet temperature control device 1 according to the embodiment of the present invention is a device that controls the temperature of a steel sheet in a heating furnace including n 1) pieces (five in the present embodiment) of heating zones disposed along a conveyance direction of the steel sheet.

The steel sheet temperature control device 1 according to the embodiment of the present invention includes a sheet temperature measurement unit 11, a furnace temperature measurement unit 12, an influence coefficient calculation unit 13, a control model setting unit 14, a state variable/disturbance estimation unit 15, a furnace temperature change amount calculation unit 16, and a furnace temperature control unit 17 as main components.

The sheet temperature measurement unit 11 measures the temperature (sheet temperature) of a steel sheet at the inlet side and the outlet side of the heating furnace at each predetermined period, and outputs an electric signal representing the sheet temperature to the state variable/disturbance estimation unit 15.

The furnace temperature measurement unit 12 measures the actual value of the temperature (furnace temperature) of each heating zone in the heating furnace at each predetermined period, and outputs an electric signal representing the measured furnace temperature of each heating zone, to the state variable/disturbance estimation unit 15, the furnace temperature change amount calculation unit 16, and the furnace temperature control unit 17.

The influence coefficient calculation unit 13 obtains a set value of the temperature of the steel sheet at the inlet side of the heating furnace, a furnace temperature set value and a sheet passing speed set value of each heating zone that are output from a process computer 21 in response to receiving an annealing command of the steel sheet. The influence coefficient calculation unit 13 calculates an influence coefficient representing the temperature change of the steel sheet at the outlet side of the heating furnace in response to the temperature change of the steel sheet at the inlet side of the heating furnace, and an influence coefficient representing the temperature change of the steel sheet at the outlet side of the heating furnace in response to the temperature change of the steel sheet in each heating zone, using the information obtained from the process computer 21. The influence coefficient calculation unit 13 then outputs electric signals representing the influence coefficients to the control model setting unit 14. A method for calculating the influence coefficients will now be described.

When the set value of the temperature of the steel sheet at the inlet side of the heating furnace is $T_{in}$, the set value of the sheet passing speed is $V_s$, and the furnace temperature set value of each heating zone is $T_{wi}$ (i=1 to 5), the temperature $T_s$ of the steel sheet at the outlet side of the heating furnace is represented as $T_s=f(T_{in}, V_s, T_{w1}, T_{w2}, T_{w3}, T_{w4}, T_{w5})$. In this example, the function f is a heating model equation of a steel sheet in the heating furnace based on the following equation (1). In calculating a numerical value, the equation (1) calculates a difference by discretizing at a suitable time step Δt. In the equation (1), ρ represents specific heat [kcal/kg/K] of the steel sheet, C represents specific gravity [kg/m$^3$] of the steel sheet, h represents sheet thickness [m] of the steel sheet, $T_s$ represents temperature [° C.] of the steel sheet, $T_w$ represents furnace temperature [° C.], $\phi_{cg}$ represents the total heat transfer coefficient [−], σ represents a Stefan-Boltzmann constant (=1.3565e$^{-11}$ [kcal/sec/m$^2$/K$^4$]), and t represents time [sec].

$$\rho \cdot C \cdot h \cdot \frac{\partial T_s(t)}{\partial t} = 2\phi_{cg}\sigma((T_w + 273.15)^4 - (T_s + 273.15)^4) \quad (1)$$

The influence coefficient calculation unit 13 calculates an influence coefficient using the information obtained from the process computer 21, and using the following equations (2) to (7). In this example, the equation (2) represents an influence coefficient expressing the temperature change of the steel sheet at the outlet side of the heating furnace in response to the temperature change of the steel sheet at the inlet side of the heating furnace, and $d_1$ in the equation (2) represents a variable representing the temperature variation of the steel sheet at the inlet side of the heating furnace. The equations (3) to (7) represent influence coefficients expressing the temperature change of the steel sheet at the outlet side of the heating furnace in response to the temperature change of the steel sheet in each heating zone.

$$\frac{\partial T_s}{\partial d_1} \cong \frac{\begin{array}{c} f(T_{in}+\Delta d_1, V_s, T_{w_1}, T_{w_2}, T_{w_3}, T_{w_4}, T_{w_5}) - \\ f(T_{in}, V_s, T_{w_1}, T_{w_2}, T_{w_3}, T_{w_4}, T_{w_5}) \end{array}}{\Delta d_1} \tag{2}$$

$$\frac{\partial T_s}{\partial T_{w_1}} \cong \frac{\begin{array}{c} f(T_{in}, V_s, T_{w_1}+\Delta T, T_{w_2}, T_{w_3}, T_{w_4}, T_{w_5}) - \\ f(T_{in}, V_s, T_{w_1}, T_{w_2}, T_{w_3}, T_{w_4}, T_{w_5}) \end{array}}{\Delta T} \tag{3}$$

$$\frac{\partial T_s}{\partial T_{w_2}} \cong \frac{\begin{array}{c} f(T_{in}, V_s, T_{w_1}, T_{w_2}+\Delta T, T_{w_3}, T_{w_4}, T_{w_5}) - \\ f(T_{in}, V_s, T_{w_1}, T_{w_2}, T_{w_3}, T_{w_4}, T_{w_5}) \end{array}}{\Delta T} \tag{4}$$

$$\frac{\partial T_s}{\partial T_{w_3}} \cong \frac{\begin{array}{c} f(T_{in}, V_s, T_{w_1}, T_{w_2}, T_{w_3}+\Delta T, T_{w_4}, T_{w_5}) - \\ f(T_{in}, V_s, T_{w_1}, T_{w_2}, T_{w_3}, T_{w_4}, T_{w_5}) \end{array}}{\Delta T} \tag{5}$$

$$\frac{\partial T_s}{\partial T_{w_4}} \cong \frac{\begin{array}{c} f(T_{in}, V_s, T_{w_1}, T_{w_2}, T_{w_3}, T_{w_4}+\Delta T, T_{w_5}) - \\ f(T_{in}, V_s, T_{w_1}, T_{w_2}, T_{w_3}, T_{w_4}, T_{w_5}) \end{array}}{\Delta T} \tag{6}$$

$$\frac{\partial T_s}{\partial T_{w_5}} \cong \frac{\begin{array}{c} f(T_{in}, V_s, T_{w_1}, T_{w_2}, T_{w_3}, T_{w_4}, T_{w_5}+\Delta T) - \\ f(T_{in}, V_s, T_{w_1}, T_{w_2}, T_{w_3}, T_{w_4}, T_{w_5}) \end{array}}{\Delta T} \tag{7}$$

The control model setting unit 14 obtains the sheet passing speed set value of each heating zone and the time constant of the furnace temperature from the process computer 21. The control model setting unit 14 calculates a control model equation required in the state variable/disturbance estimation unit 15 and the furnace temperature change amount calculation unit 16, using the information obtained from the process computer 21. The control model setting unit 14 then outputs an electric signal representing a parameter of the calculated control model equation to the state variable/disturbance estimation unit 15 and the furnace temperature change amount calculation unit 16. A method for calculating the control model equation will now be described.

When transfer time $L_1[s]$ for transferring a steel sheet from the inlet position of the i-th heating zone to the outlet side position of the heating furnace (distance/sheet passing speed set value from the inlet side position of the i-th heating zone to the outlet side of the heating furnace) is required, the temperature $T_s$ of the steel sheet at the outlet side of the heating furnace is represented by the following equation (8) using the influence coefficients in the equations (2) to (7). In this example, $\Delta T_{wi}$ in the equation (8) is a differential value between the furnace temperature actual value and the furnace temperature set value of each heating zone, and represents the furnace temperature variation. Moreover, s is a Laplace operator.

$$\left.\begin{array}{l} T_s = \left(\frac{\partial T_s}{\partial T_{w_1}}\Delta T_{w_1} + \frac{\partial T_s}{\partial d_1}d_1\right)e^{-L_1 s} + \frac{\partial T_s}{\partial T_{w_2}}\Delta T_{w_2}e^{-L_2 s} + \\ \frac{\partial T_s}{\partial T_{w_3}}\Delta T_{w_3}e^{-L_3 s} + \frac{\partial T_s}{\partial T_{w_4}}\Delta T_{w_4}e^{-L_4 s} + \frac{\partial T_s}{\partial T_{w_5}}\Delta T_{w_5}e^{-L_5 s} \end{array}\right\} \tag{8}$$

It is assumed that a feedback control system is built from the furnace temperature command value to the furnace temperature actual value, and the furnace temperature control system can be approximated by the dynamic characteristic described in the following equation (9). In this example, $\Delta T_{wi}^{ref}$ in the equation (9) represents the furnace temperature target value of each heating zone, and $T_i$ represents the time constant from the furnace temperature command value to the furnace temperature actual value of each heating zone.

$$\frac{\Delta T_{w_1}}{\Delta T_{w_1}^{ref}} = \frac{1}{T_i s + 1},\ i = 1, 2, 3, 4, 5 \tag{9}$$

It is also assumed that the transfer time element $e^{-Lis}$ in the equation (8) can be linearized by Pade approximation as illustrated in the following equation (10). The equation (10) is the third-order equation. However, the order of equation can be suitably set by the designer. When the equation (10) is expressed in state space representation, the following equation (11) can be obtained. In the equation (11), $x_1$, $x_2$, and $x_3$ are internal state variables, and may be optionally implemented. Consequently, $x_1$, $x_2$, and $x_3$ do not have any physical meaning.

$$\frac{Y}{U} = e^{-Lis} \approx \frac{b_2 s^2 + b_1 s + b_0}{s^3 + a_2 s^2 + a_1 s + a_0} + d_0 \tag{10}$$

$$\left.\begin{array}{l} \frac{d}{dt}\begin{bmatrix} x_1 \\ x_2 \\ x_3 \end{bmatrix} = \begin{bmatrix} 0 & 1 & 0 \\ 0 & 0 & 1 \\ -a_0 & -a_1 & -a_2 \end{bmatrix}\begin{bmatrix} x_1 \\ x_2 \\ x_3 \end{bmatrix} + \begin{bmatrix} 0 \\ 0 \\ 1 \end{bmatrix}u \\ y = [b_0\ \ b_1\ \ b_2]\begin{bmatrix} x_1 \\ x_2 \\ x_3 \end{bmatrix} + d_0 u \end{array}\right\} \tag{11}$$

When the equation (8) and the equation (11) are considered together, the state space representations to the sheet temperature variation $T_{si}$ from the furnace temperature variation $\Delta T_{wi}$ of each heating zone and the temperature variation $d_1$ of the steel sheet at the inlet side of the heating furnace are expressed by the following equations (12) and (13). In this example, the equation (12) represents the equation of the first heating zone, and the equation (13) represents the equation of the second to fifth heating zones. Moreover, $T_{si}$ represents the sheet temperature variable indicating the i-th term in the equation (8).

$$\left.\begin{array}{l} \frac{d}{dt}\begin{bmatrix} x_{10} \\ x_{11} \\ x_{12} \end{bmatrix} = \begin{bmatrix} 0 & 1 & 0 \\ 0 & 0 & 1 \\ -a_{10} & -a_{11} & -a_{12} \end{bmatrix}\begin{bmatrix} x_{10} \\ x_{11} \\ x_{12} \end{bmatrix} + \begin{bmatrix} 0 \\ 0 \\ 1 \end{bmatrix} \\ \left(\frac{\partial T_s}{\partial T_{w_1}}\Delta T_{w_1} + \frac{\partial T_s}{\partial d_1}d_1\right) \\ T_{s_1} = [b_{10}\ \ b_{11}\ \ b_{12}]\begin{bmatrix} x_{10} \\ x_{11} \\ x_{12} \end{bmatrix} + d_{10}\left(\frac{\partial T_s}{\partial T_{w_1}}\Delta T_{w_1} + \frac{\partial T_s}{\partial d_1}d_1\right) \end{array}\right\} \tag{12}$$

$$\left.\begin{array}{l} \frac{d}{dt}\begin{bmatrix} x_{i0} \\ x_{i1} \\ x_{i2} \end{bmatrix} = \begin{bmatrix} 0 & 1 & 0 \\ 0 & 0 & 1 \\ -a_{i0} & -a_{i1} & -a_{i2} \end{bmatrix}\begin{bmatrix} x_{i0} \\ x_{i1} \\ x_{i2} \end{bmatrix} + \begin{bmatrix} 0 \\ 0 \\ 1 \end{bmatrix} \\ \left(\frac{\partial T_s}{\partial T_{w_i}}\Delta T_{w_i}\right) \\ T_{s_1} = [b_{i0}\ \ b_{i1}\ \ b_{i2}]\begin{bmatrix} x_{i0} \\ x_{i1} \\ x_{i2} \end{bmatrix} + d_{i0}\left(\frac{\partial T_s}{\partial T_{w_i}}\Delta T_{w_i}\right) \end{array}\right\} \tag{13}$$

Moreover, the state space representation of the dynamic characteristic equation of the furnace temperature control system represented by the equation (9) is expressed as the following equation (14).

$$\frac{d\Delta T_{w_i}}{dt} = -\frac{1}{T_i}\Delta T_{w_i} + \frac{1}{T_i}\Delta T_{w_i}^{ref},\ i = 1, 2, 3, 4, 5 \tag{14}$$

The observable output of the furnace temperature control system is the furnace temperature variable $\Delta T_{wi}$ of each heating zone and the temperature $T_s$ of the steel sheet at the outlet side of the heating furnace. When an unknown variable $d_2$ indicating a disturbance applied to the temperature of the steel sheet at the outlet side of the heating furnace is introduced to the temperature $T_s$ of the steel sheet, the temperature $T_s$ of the steel sheet is expressed by the following equation (15). When it is assumed that the time differentiation of the temperature variable $d_1$ of the steel sheet at the inlet side of the steel sheet is 0, as expressed by the equation (16), the state space representation expressed by the following equation (17) is obtained from the equations (12) to (16).

$$T_s = T_{s_1} + T_{s_2} + T_{s_3} + T_{s_4} + T_{s_5} + d_2 \tag{15}$$

$$\frac{d}{dt}d_1 = 0 \tag{16}$$

$$\left.\begin{aligned} \frac{dx}{dt} &= Ax + Bu + Ed_2 \\ y &= Cx + Fd_2 \end{aligned}\right\} \tag{17}$$

$$\text{where, } x = \begin{bmatrix} \Delta T_{w_1} \\ \vdots \\ \Delta T_{w_5} \\ x_{010} \\ x_{011} \\ x_{012} \\ \vdots \\ x_{052} \\ d_1 \end{bmatrix} \quad y = \begin{bmatrix} \Delta T_{w_1} \\ \vdots \\ \Delta T_{w_5} \\ T_s \end{bmatrix} \quad u = \begin{bmatrix} \Delta T_{w_1}^{ref} \\ \vdots \\ \Delta T_{w_5}^{ref} \end{bmatrix}$$

$A$: $21 \times 21$ matrix
$B$: $21 \times 5$ matrix
$E$: $21 \times 1$ matrix
$C$: $6 \times 20$ matrix
$F$: $6 \times 1$ matrix The control model setting unit 14 then outputs the result obtained by discretizing the matrices A to F in the equation (17) (hereinafter, the continuous time representation and the discrete time representation are represented by the same symbol) by the control period, to the state variable/disturbance estimation unit 15 and the furnace temperature change amount calculation unit 16, as a parameter of the control model equation.

The state variable/disturbance estimation unit 15 estimates the state variable and the disturbance variable of the control model equation calculated by the control model setting unit 14 at each control period, using an estimation method such as observer and Kalman filter, and outputs electric signals representing the estimated values to the furnace temperature change amount calculation unit 16. When the observer is used for estimation, the state variable/disturbance estimation unit 15 modifies the equation (17) to the following equation (18). The state variable/disturbance estimation unit 15 then designs an observer for the system. The following equation (19) is the observer, and is obtained by multiplying the observer gain L by a deviation between the observed value y and a model prediction value, while setting the state estimated value to x' and the disturbance estimated value to d2'. The following equation (19) updates the estimated values of the state amount and the disturbance. In the equation (19), u(k) represents the furnace temperature target value of each heating zone input by the furnace temperature control unit 17. To design the observer gain, a designing method to stabilize the system has been known (for example, System Control Theory Introduction (Jikkyo Shuppan, 1979)).

$$\left.\begin{aligned} \begin{bmatrix} x(k+1) \\ d_2(k+1) \end{bmatrix} &= \begin{bmatrix} A & E \\ 0_{1\times 21} & 1 \end{bmatrix}\begin{bmatrix} x(k) \\ d_2(k) \end{bmatrix} x + \begin{bmatrix} B \\ 0_{1\times 5} \end{bmatrix} u(k) \\ y(k) &= [C\ \ F]\begin{bmatrix} x(k) \\ d_2(k) \end{bmatrix} \end{aligned}\right\} \tag{18}$$

$$\begin{bmatrix} x'(k+1) \\ d_2'(k+1) \end{bmatrix} = \begin{bmatrix} A & E \\ 0_{1\times 21} & 1 \end{bmatrix}\begin{bmatrix} x'(k) \\ d_2'(k) \end{bmatrix} + \begin{bmatrix} B \\ 0_{1\times 5} \end{bmatrix} u(k) + L\left(y(k) - [C\ \ F]\begin{bmatrix} x'(k) \\ d_2'(k) \end{bmatrix}\right) \tag{19}$$

The furnace temperature change amount calculation unit 16 calculates the furnace temperature change amount such that the square sum of the deviation between the target value and the actual value of the temperature of the steel sheet at the outlet side of the heating furnace becomes minimum, in other words, the variation from the target value of the temperature of the steel sheet at the outlet side of the heating furnace becomes minimum, by using the estimated values of the state variable and the disturbance variable output from the state variable/disturbance estimation unit 15. This leads to a problem of minimizing the target function under the constraint conditions. More specifically, even though the equation (18) is already obtained as the control model equation, the input is modified as the following equation (20) to handle the variation constraint of the furnace temperature target value. The furnace temperature change amount calculation unit 16 then calculates the furnace temperature change amount Δu(k) with which the sheet temperature variation $T_s^2$ becomes minimum by using the control model equation. This is an optimization problem for calculating the time series data of the furnace temperature change amount Δu(k) for minimizing the evaluation function expressed by the following equation (21).

$$\left.\begin{aligned} \begin{bmatrix} x(k+1) \\ d(k+1) \\ u(k+1) \end{bmatrix} &= \begin{bmatrix} A & E & B \\ O_{1\times 21} & I_{1\times 1} & O_{1\times 5} \\ O_{5\times 21} & O_{5\times 1} & I_{5\times 5} \end{bmatrix}\begin{bmatrix} x(k) \\ d(k) \\ u(k) \end{bmatrix} + \begin{bmatrix} O_{n\times 5} \\ O_{1\times 5} \\ I_{5\times 5} \end{bmatrix}\Delta u(k) \\ y(k) &= [C\ \ F\ \ O_{6\times 5}]\begin{bmatrix} x(k) \\ d(k) \\ u(k) \end{bmatrix} \end{aligned}\right\} \tag{20}$$

$$\min_{\Delta u(0),\Delta u(1)\ldots,\Delta u(N)} J = \sum_{k=0}^{N-1}(x(k)^T Qx(k) + \Delta u(k)^T R\Delta u(k)) \tag{21}$$

In this example, values output from the state variable/disturbance estimation unit 15 are used as the initial values of the state variable and the disturbance variable. In the equation (21), $x(k)^T$ represents transposition of a vector. N in the equation (21) is the prediction period and means that the future N control period is evaluated from the current time. By setting $Q=c^Tc$ (c represents the last line corresponding to the steel sheet temperature of the $[C\ F\ O_{6\times5}]$ matrix), the evaluation function can minimize the temperature variation of the steel sheet including the disturbance at the inlet side and the outlet side of the heating furnace.

Moreover, the constraint conditions include constraint condition relating to the upper and lower limit values of the furnace temperature, constraint condition relating to the furnace temperature change amount per unit time, constraint condition relating to the upper and lower limit values of the fuel flow rate, and condition relating to the fuel flow rate change amount per unit time. Furthermore, it is possible to obtain a relation between the fuel flow rate and the furnace temperature target value u(k) and integrating the relation in the constraints, or constrain the furnace temperature target value u(k). In this manner, it is possible to integrate the constraint conditions of the operation. Among the time series data of the furnace temperature change amount Δu(k) calculated in this process, the furnace temperature change amount calculation unit 16 outputs the furnace temperature change amount Δu(0) of the first time to the furnace temperature control unit 17.

The furnace temperature control unit 17 adds the furnace temperature change amount Δu(0) to the furnace temperature target at the current time, and sets the usage amount of the fuel amount flow rate in each heating zone to achieve the target. It is preferable that the influence coefficient calculation unit 13, the control model setting unit 14, the state variable/disturbance estimation unit 15, and the furnace temperature change amount calculation unit 16 each execute a process for each set value of a plurality of sheet passing speeds that can be assumed during the actual operation. It is also preferable that the furnace temperature control unit 17 controls the fuel flow rate used in each heating zone to achieve the furnace temperature change amount calculated from the set value of the sheet passing speed close to the actual sheet passing speed.

As is evident from the above description, in the steel sheet temperature control device 1 according to the embodiment of the present invention, the state variable/disturbance estimation unit 15 estimates the values of the state variable and the temperature disturbance variable of the control model at the same time. Moreover, the furnace temperature change amount calculation unit 16 calculates the furnace temperature change amount of each heating zone under the constraint conditions such that the square sum of the deviation between the target value and the actual value of the temperature of the steel sheet at the outlet side of the heating furnace becomes minimum, using the values of the state variable and the temperature disturbance variable of the control model. Furthermore, the furnace temperature control unit 17 controls the fuel flow rate used in each heating zone to achieve the calculated furnace temperature change amount. Consequently, it is possible to control the temperature of the steel sheet in the heating furnace with a good responsiveness and a good follow-up capability.

EXAMPLES

Figure 2:
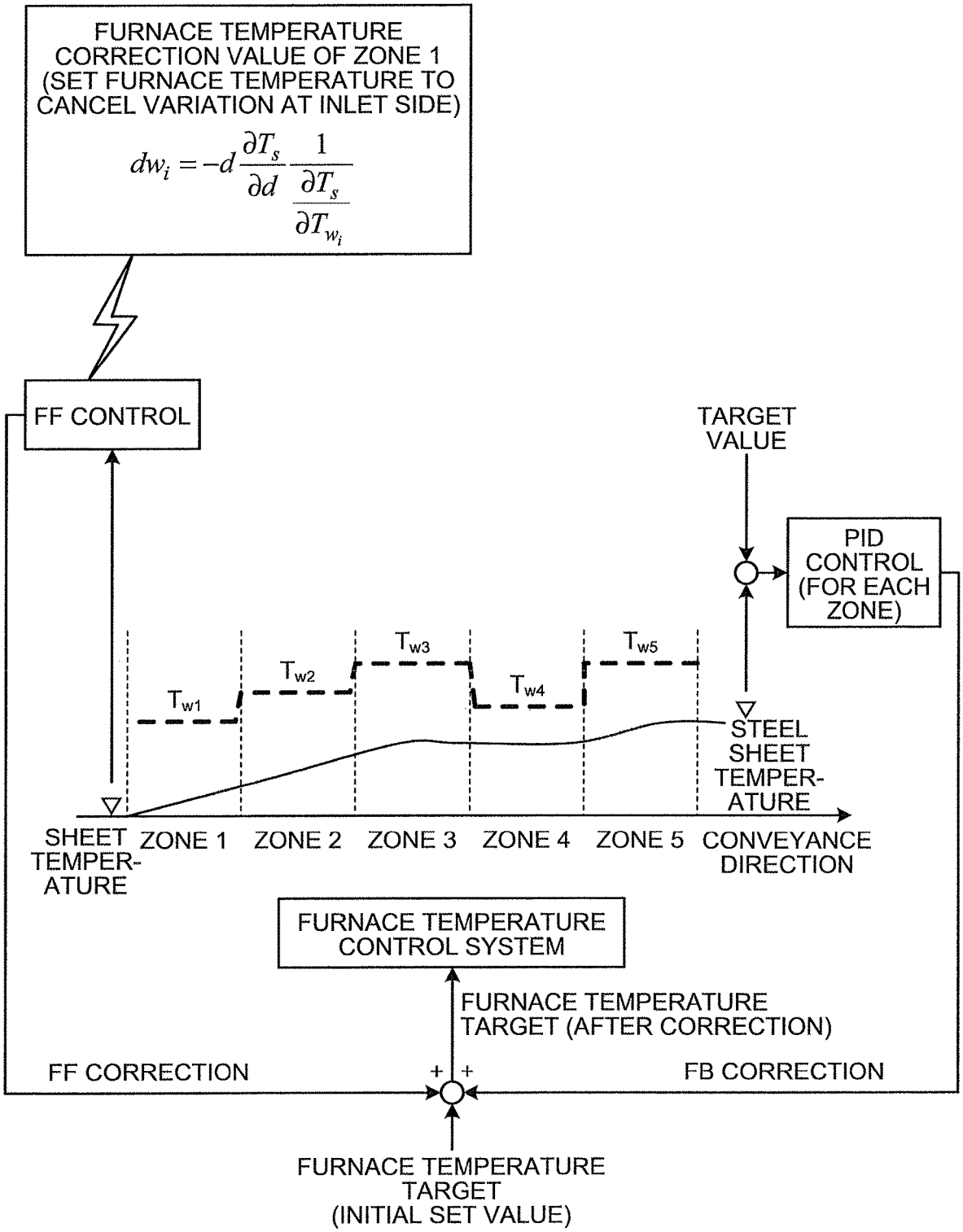
FIG. 2 is a block diagram illustrating a configuration of a conventional steel sheet temperature control device.
Figure 3:
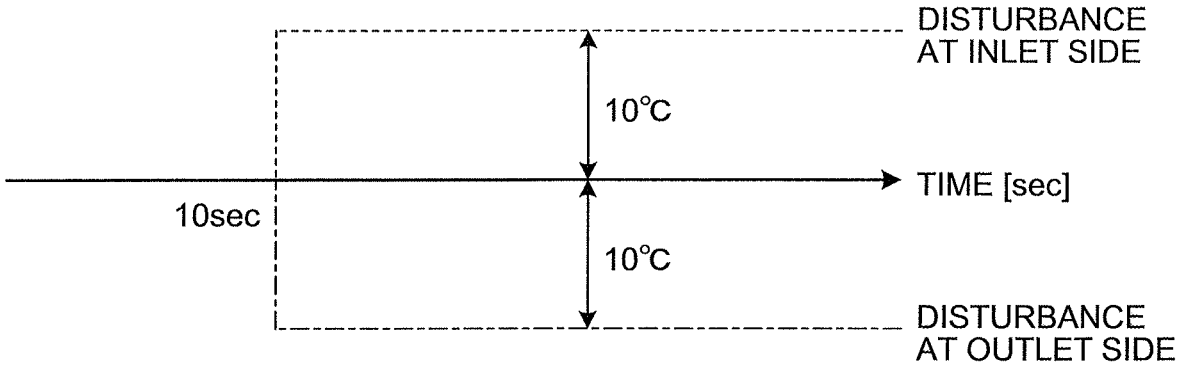
FIG. 3 is a diagram illustrating a disturbance applied to the temperature of a steel sheet at the inlet side and the outlet side of a heating furnace.

The effectiveness of aspects of the present invention method was validated by simulation. The set values of the heating zones are described in the following table 1 and the set values of the steel sheets are described in the following table 2. As the constraint condition according to aspects of the present invention method, the furnace temperature target change amount [° C./s] in all the heating zones is set to equal to or less than ±1.0° C./sec. The prediction period N of the evaluation function is set to 30. Meanwhile, an exemplary configuration of a conventional method is illustrated in FIG. 2 for comparison. As illustrated in FIG. 2, in the exemplary configuration of the conventional method, the sheet temperature variation due to the temperature disturbance at the inlet side of the heating furnace is suppressed by feedforward (FF) control (FF correction), and the actual control deviation of the temperature of the steel sheet at the outlet side of the heating furnace is suppressed by proportional-integral-derivative (PID) control (feedback (FB) correction). The two controls are independently designed, and the conventional method differs from aspects of the present invention method in that information on the furnace temperature correction values are not exchanged with each other. The feedforward control calculates the furnace temperature change amount to remove the influence of the disturbance, which is applied to the temperature of the steel sheet at the inlet side of the heating furnace, applied to the temperature of the steel sheet at the outlet side of the heating furnace, using the influence coefficients. To compare the responses between aspects of the present invention method and the conventional method when a disturbance is applied, the disturbance illustrated in FIG. 3 is applied to the temperature of the steel sheet at the inlet side and the outlet side of the heating furnace.

TABLE 1

| | Installation length | Furnace temperature (Initial set value) [° C.] | Furnace temperature control time constant |
|---|---|---|---|
| Zone 1 | 20.4 | 746 | 30 |
| Zone 2 | 5.1 | 1061 | 30 |
| Zone 3 | 5.1 | 1056 | 30 |
| Zone 4 | 5.1 | 1061 | 30 |
| Zone 5 | 5.1 | 1054 | 30 |

TABLE 2

| | Unit | Value |
|---|---|---|
| Sheet thickness | mm | 2.0 |
| Sheet passing speed | m/sec | 1.0 |
| Total heat transfer coefficient | — | 1.00 |
| Control period | sec | 5.0 |

Figure 4:
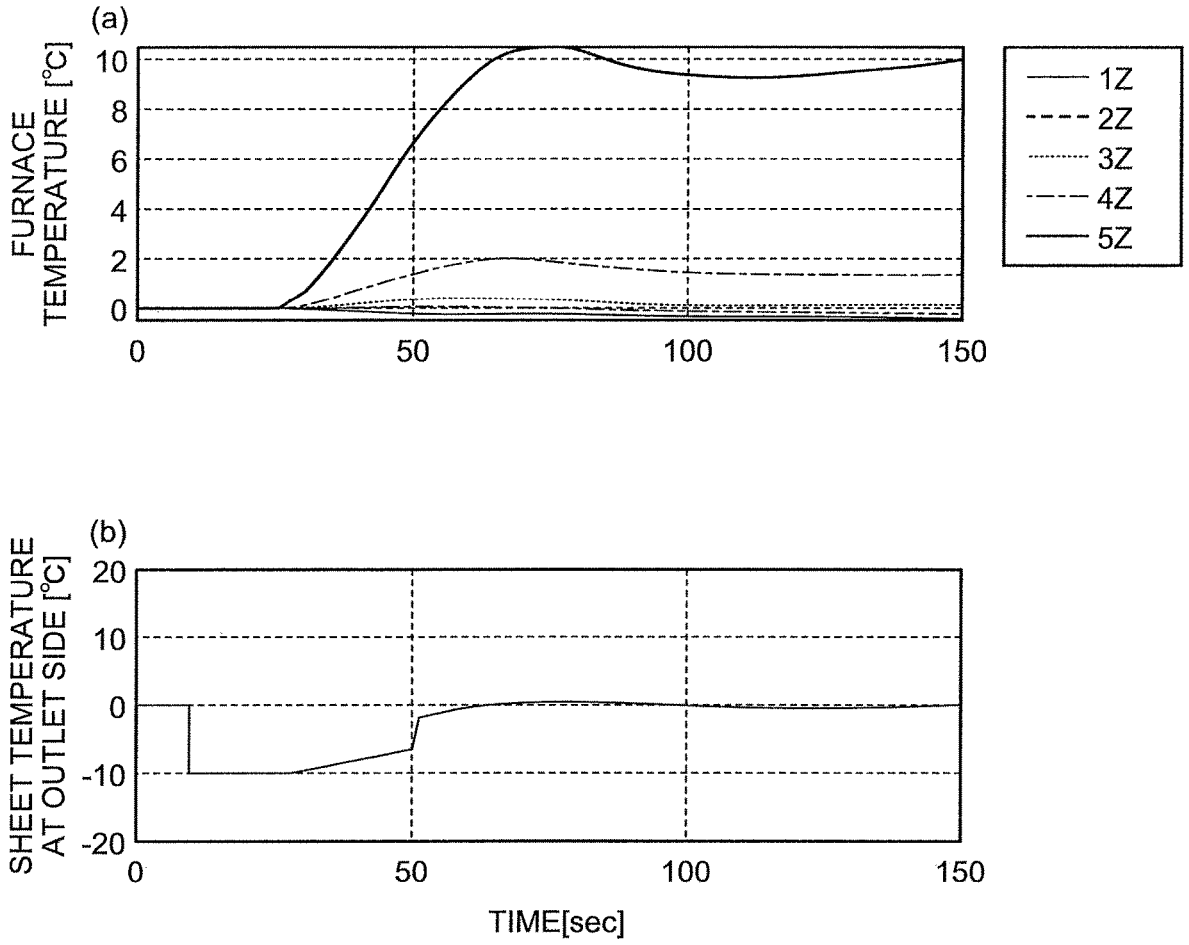
FIG. 4 is a diagram illustrating furnace temperature of each heating zone and temperature response of the steel sheet at the outlet side of the heating furnace in accordance with aspects of the present invention method.
Figure 5:
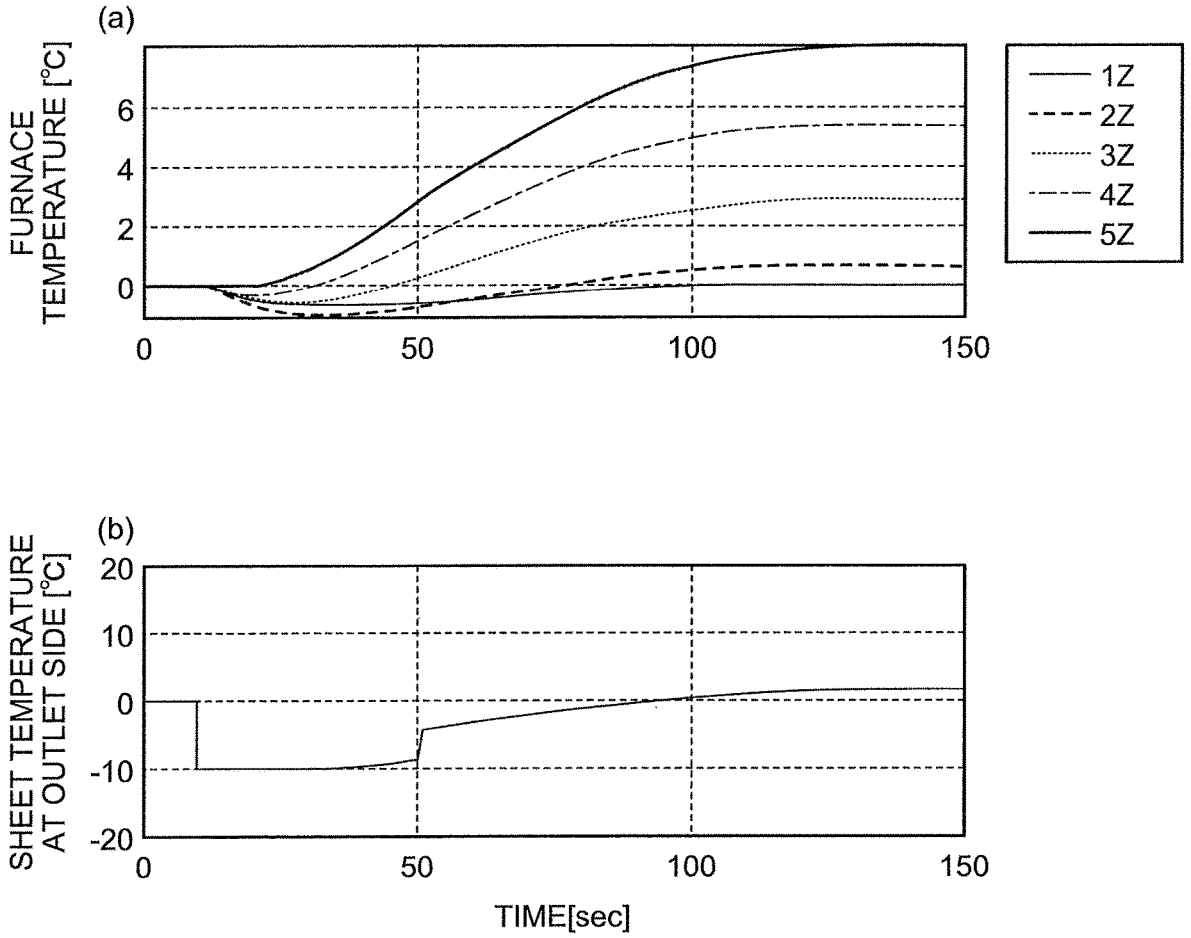
FIG. 5 is a diagram illustrating furnace temperature of each heating zone and temperature response of the steel sheet at the outlet side of the heating furnace in a conventional method.

The furnace temperatures of the heating zones (1 to 5Z) and the temperature response of the steel sheet at the outlet side of the heating furnace in accordance with aspects of the present invention method are illustrated in FIGS. 4(*a*) and (*b*). The furnace temperatures of the heating zones (1 to 5Z) and the temperature response of the steel sheet at the outlet side of the heating furnace of the convention method are illustrated in FIGS. 5(*a*) and (*b*). As illustrated in FIGS. 4(*a*) and (*b*), in accordance with aspects of the present invention method, the temperature of the steel sheet at the outlet side of the heating furnace is converged to the target value (0° C.) at least about 60 seconds have passed. Alternatively, as illustrated in FIGS. 5(*a*) and (*b*), in the conventional method, the control deviation is still present in the temperature of the steel sheet at the outlet side of the heating furnace even 100 seconds or more have passed. In this manner, it was confirmed that the time required for the temperature of the steel sheet at the outlet side of the heating furnace to converge to the target value is short, and the control deviation is eliminated in accordance with aspects of the present invention method.

Figure 6:
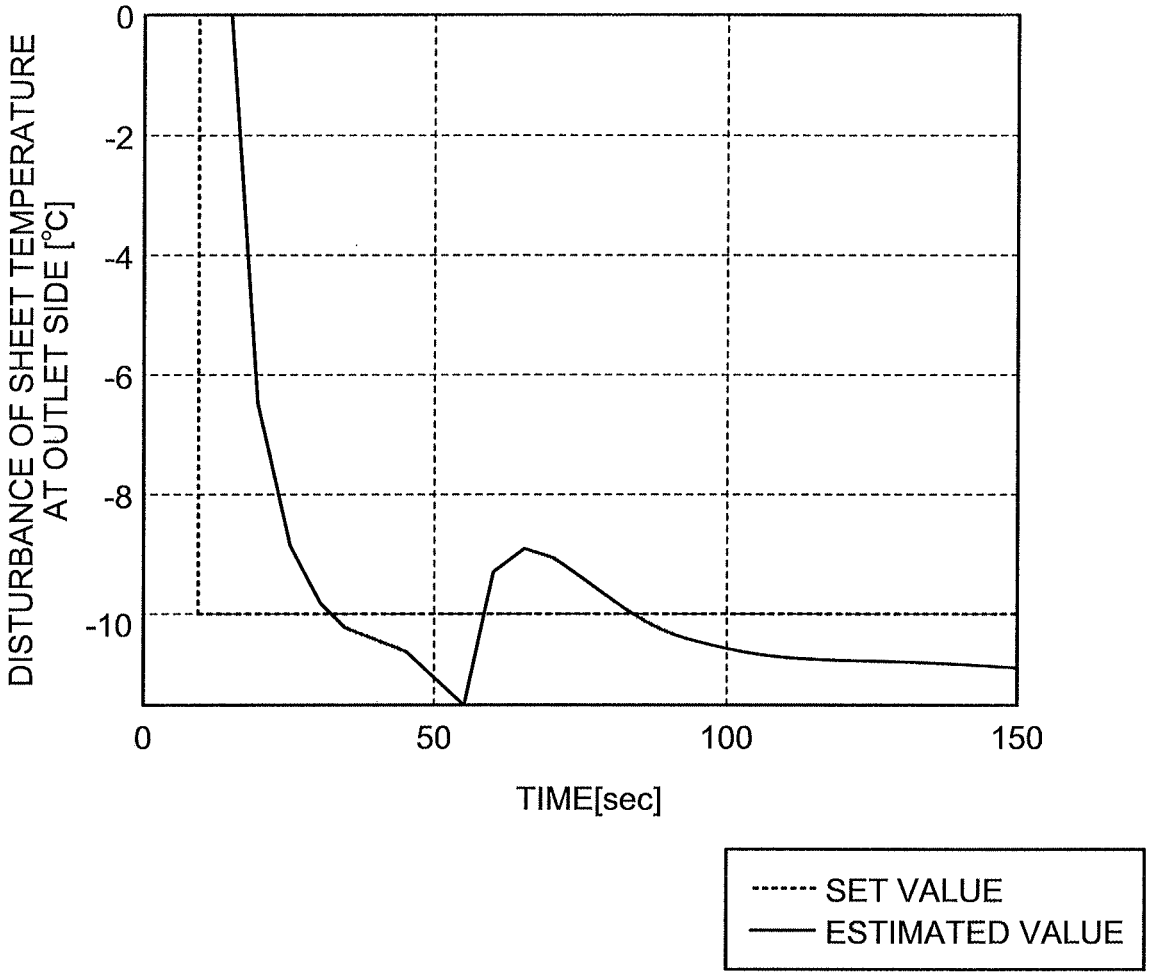
FIG. 6 is a diagram illustrating a disturbance applied to the temperature of the steel sheet at the outlet side of the heating furnace.

One difference between aspects of the present invention method and the conventional method is the directivity of the change amount of the furnace temperature when a disturbance is applied to the temperature of the steel sheet at the inlet side of the heating furnace. In other words, in the conventional method, even when the temperature of the steel sheet at the outlet side of the heating furnace is lower than the target value, the furnace temperature is lowered when a positive disturbance is applied to the temperature of the steel sheet at the inlet side of the heating furnace. However, this is a reverse operation when viewed from the temperature of the steel sheet at the outlet side of the heating furnace. Thus, the furnace temperature varies, and it takes time to converge. Alternatively, in accordance with aspects of the present invention method, even when a positive disturbance is applied to the temperature of the steel sheet at the inlet side of the heating furnace, when the current temperature of the steel sheet at the outlet side of the heating furnace is lower than the target value, the furnace temperature will not be lowered, and the furnace temperature is controlled to the condition that can eventually eliminate the steady-state deviation. This is because the disturbance applied to the temperature of the steel sheet at the outlet side of the heating furnace is estimated for each control period as illustrated in FIG. 6, and a suitable operation amount is optimally calculated.

Although the embodiment has been described according to aspects of the invention made by the present inventors, the present invention is not limited to the description and the drawings forming a part of the disclosure of the present invention according to the present embodiment. That is, all other embodiments made by those skilled in the art on the basis of the present embodiment, examples, operation techniques, and the like are all included in the scope of the present invention.

INDUSTRIAL APPLICABILITY

With the present invention, it is possible to provide the steel sheet temperature control device and the steel sheet temperature control method that can control the temperature of a steel sheet in a heating furnace with a good responsiveness and a good follow-up capability.

REFERENCE SIGNS LIST

1 steel sheet temperature control device
11 sheet temperature measurement unit
12 furnace temperature measurement unit
13 influence coefficient calculation unit
14 control model setting unit
15 state variable/disturbance estimation unit
16 furnace temperature change amount calculation unit
17 furnace temperature control unit

The invention claimed is:

1. A steel sheet temperature control device, comprising:

a sheet temperature measurement unit that measures temperature of a steel sheet at an inlet side and an outlet side of a heating furnace including a plurality of heating zones disposed along a conveyance direction of the steel sheet;

a furnace temperature measurement unit that measures furnace temperature of each of the heating zones; and a process computer configured to execute a process, the process including:

calculating an influence coefficient representing temperature change of the steel sheet at the outlet side of the heating furnace in response to temperature change of the steel sheet at the inlet side of the heating furnace, and an influence coefficient representing temperature change of the steel sheet at the outlet side of the heating furnace in response to change in the furnace temperature of each of the heating zones, using a heating model equation capable of calculating the temperature of the steel sheet in the heating furnace, by inputting a set value of the temperature of the steel sheet at the inlet side of the heating furnace, and set values of the furnace temperature of each of the heating zones and sheet passing speed;

setting a control model by inputting a furnace temperature change command value and outputting the furnace temperature of each of the heating zones and the temperature of the steel sheet at the outlet side of the heating furnace, by using the calculated influence coefficient, transfer time of the steel sheet until influence of furnace temperature change in each of the heating zones appears on the temperature of the steel sheet at the outlet side of the heating furnace, a time constant from when the furnace temperature change command value of each of the heating zones is output to when the furnace temperature is actually changed, and a variable representing unknown temperature disturbance to be applied to the temperature of the steel sheet at the outlet side of the heating furnace;

estimating values of a state variable and a temperature disturbance variable of the control model at the same time, by inputting a deviation between an actual value of the temperature of the steel sheet at the inlet side of the heating furnace measured by the sheet temperature measurement unit and a set value, a deviation between an actual value of the temperature of the steel sheet at the outlet side of the heating furnace measured by the sheet temperature measurement unit and a set value, and a deviation between an actual value of the furnace temperature of each of the heating zones measured by the furnace temperature measurement unit and an initial set value;

calculating a furnace temperature change amount of each of the heating zones under a constraint condition such that square sum of a deviation between a target value and the actual value of the temperature of the steel sheet at the outlet side of the heating furnace becomes minimum, by using the estimated values of the state variable and the temperature disturbance variable of the control model; and controlling a fuel flow rate used in each of the heating zones to achieve the calculated furnace temperature change amount.

2. The steel sheet temperature control device according to claim 1, wherein calculating the furnace temperature change amount includes at least one of constraint condition relating to upper and lower limit values of the furnace temperature, constraint condition relating to the furnace temperature change amount per unit time, constraint condition relating to upper and lower limit values of the fuel flow rate, and condition relating to the fuel flow rate change amount per unit time, as the constraint condition.

3. The steel sheet temperature control device according to claim 1, wherein the calculating of the influence coefficient, the setting, the estimating, and the calculating of the furnace temperature change amount are performed for each set value of a plurality of sheet passing speeds assumable during an actual operation, and the controlling includes controlling a fuel flow rate used in each of the heating zones to achieve the furnace temperature change amount calculated from the set value of the sheet passing speed close to actual sheet passing speed.

4. A steel sheet temperature control method, comprising:

smeasuring temperature of a steel sheet at an inlet side and an outlet side of a heating furnace including a plurality of heating zones disposed along a conveyance direction of the steel sheet;

measuring furnace temperature of each of the heating zones;

calculating a first influence coefficient representing temperature change of the steel sheet at the outlet side of the heating furnace in response to temperature change of the steel sheet at the inlet side of the heating furnace, and a second influence coefficient representing temperature change of the steel sheet at the outlet side of the heating furnace in response to change in the furnace temperature of each of the heating zones, using a heating model equation capable of calculating the temperature of the steel sheet in the heating furnace, by inputting a set value of the temperature of the steel sheet at the inlet side of the heating furnace, and set values of the furnace temperature of each of the heating zones and sheet passing speed;

setting a control model by inputting a furnace temperature change command value and outputting the furnace temperature of each of the heating zones and the temperature of the steel sheet at the outlet side of the heating furnace, by using the first influence coefficient and the second influence coefficient, transfer time of the steel sheet until influence of furnace temperature change in each of the heating zones appears on the temperature of the steel sheet at the outlet side of the heating furnace, a time constant from when the furnace temperature change command value of each of the heating zones is output to when the furnace temperature is actually changed, and a variable representing unknown temperature disturbance to be applied to the temperature of the steel sheet at the outlet side of the heating furnace;

estimating values of a state variable and a temperature disturbance variable of the control model at the same time, by inputting a deviation between an actual value of the measured temperature of the steel sheet at the inlet side of the heating furnace and a set value, a deviation between an actual value of the measured temperature of the steel sheet at the outlet side of the heating furnace and a set value, and a deviation between an actual value of the measured furnace temperature of each of the heating zones and an initial set value;

calculating a furnace temperature change amount of each of the heating zones under a constraint condition such that square sum of a deviation between a target value and the actual value of the temperature of the steel sheet at the outlet side of the heating furnace becomes minimum, by using the estimated values of the state variable and the temperature disturbance variable of the control model; and controlling a fuel flow rate used in each of the heating zones to achieve the calculated furnace temperature change amount.

5. The steel sheet temperature control device according to claim 2, wherein calculating of the influence coefficient, the setting, the estimating, and the calculating of the furnace temperature change amount are performed for each set value of a plurality of sheet passing speeds assumable during an actual operation, and the controlling includes controlling a fuel flow rate used in each of the heating zones to achieve the furnace temperature change amount calculated from the set value of the sheet passing speed close to actual sheet passing speed.

* * * * *